US006349417B1

(12) United States Patent
Chiang

(10) Patent No.: US 6,349,417 B1
(45) **Date of Patent: *Feb. 26, 2002**

(54) SWIMMING GOGGLES WITH STEP-LESS ADJUSTMENT

(76) Inventor: Herman Chiang, 11F-2, No. 634-9, Ching-Ping Rd., Chung-Ho City, Taipei, Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/541,233

(22) Filed: Apr. 3, 2000

(51) Int. Cl.[7] ..... A61F 9/02
(52) U.S. Cl. ..... 2/428; 2/445
(58) Field of Search ..... 2/426, 428, 430, 2/440, 442, 445, 446, 452; 351/43, 155, 156

(56) References Cited

U.S. PATENT DOCUMENTS 5,502,844 A * 4/1996 Alvarado ..... 2/445
5,857,221 A * 1/1999 Geneve et al. ..... 2/428
6,119,277 A * 9/2000 Chiang ..... 2/428
6,119,279 A * 9/2000 Haslbeck ..... 2/445

* cited by examiner

*Primary Examiner*—John J. Calvert
*Assistant Examiner*—Katherine Moran
(74) *Attorney, Agent, or Firm*—Pro-Techtor International Services

(57) ABSTRACT

A type of swimming goggles, comprising: two lens frame units, each lens frame unit accommodating a lens, and, at its two opposite ends are a first joining unit and a second joining unit, on each joining unit are two accommodating holes with clasp openings; at least one string that is pulled through the accommodating holes on the first and second joining units on the two lens frame units, maintaining an appropriate distance between the two lens frames; and a headband device that is joined to the two joining units on the outside of the two lens frame units, by such features in configuration, the user can regulate the length of string between the two lens frames, and adjust the span of the nose bridge.

7 Claims, 4 Drawing Sheets

SWIMMING GOGGLES WITH STEP-LESS ADJUSTMENT

FIELD OF THE INVENTION

The subject invention relates to a type of swimming goggles with step-less adjustment, or specifically, to one with step-less adjustment of nose bridge to suit swimmers that require different spans of nose bridges.

BACKGROUND OF THE INVENTION

As we know, the nose bridge of a conventional type of swimming goggles may be adjusted to lengthen or shorten the span between the left and right lens frames, to suit different face shapes of different users. However, the nose bridge of the conventional type of swimming goggles involves only three-step adjustment (as shown in FIG. 1), therefore, it could not satisfy the need of the general consumers. Besides, the conventional type of swimming goggles involves a check mechanism for the adjustment, it results in easier an adjustment in the natural direction but a difficult operation in the reverse direction. As illustrated in FIG. 1, the nose bridge of a prior art of swimming goggles 7 involves a plate unit 71, on which are several ribs 710 that are checked against a seat 720 on a lens frame 72. The opposite sides of the ribs 710 are designed to have guided sides. But, for the sake of checking performance, one of the sides has a larger guided angle, so it is more labor-consuming in the process of adjustment. In case of improper operation, it may even result in failure of movement. More worrisome is that, during the adjustment and moving process, the ribs 710 on the seat 71 will be squeezed and deformed by the seat 720. After extended use, said ribs 710 will be flattened and could not be engaged effectively to the seat 720. The result will be loose swimming goggles when worn by the user, or even water seepage. Some users who could not coordinate with the 3-step adjustment will feel uncomfortable. In view of the above drawbacks, it has become a subject for breakthrough to seek a design of swimming goggles to suit the different spans of nose bridge of different users.

BRIEF DESCRIPTION OF THE INVENTION

The primary objective of the subject invention of swimming goggles with step-less adjustment is to provide a type of swimming goggles with step-less adjustment of nose bridge span, so the nose bridge span of the swimming goggles can be adjusted to suit different user's requirements. The nose bridge in the subject invention of swimming goggles can be pulled to enlarge or reduce its span, to suit the nose shape of the user.

CHARACTERISTICS OF THE INVENTION

The subject invention of swimming goggles with step-less adjustment lies in that: at two ends of the longer axis of the lens frame of the swimming goggle are first joining units and second joining units, the formation of the nose bridge being at least one string that is positioned onto the first and second joining units of the left and right lens frames along the rim of the lens frame units, maintaining an appropriate span between the two lens frames, that is, the nose bridge is composed of the strings connecting two lens frames to maintain an appropriate span. With such features, the user can adjust the strings and the span between two lens frames, to achieve the effect of step-less adjustment of the span of nose bridge of swimming goggles.

According to the above features, the two strings are wound in position respectively along the upper and lower rims of the lens frame units, with a length exposed at one end on the outside of the lens frame unit, to facilitate control in the adjustment of the span.

According to the above features, the first joining units are located on the inside of the lens frame, while the second joining unit is located on the outside of the lens frame, the two joining units respectively have accommodating holes with at least one clasp opening, said clasp opening serving to position the two ends of the strings for the nose bridge.

Detailed Description of Preferred Embodiment

Figure 1:
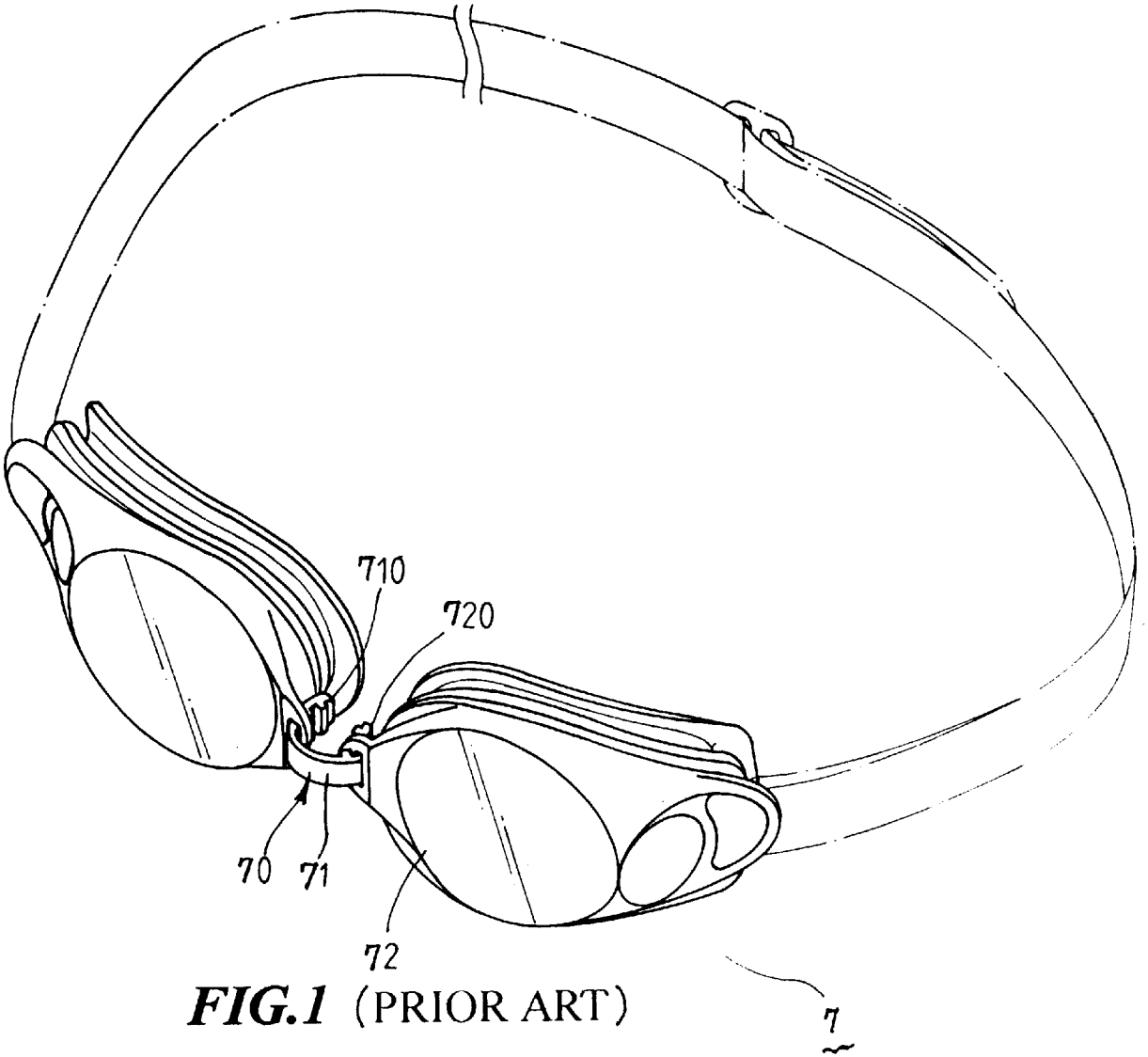
FIG.1 (PRIOR ART)
FIG. 1 is a perspective view of a prior art of swimming goggles.
Figure 2:
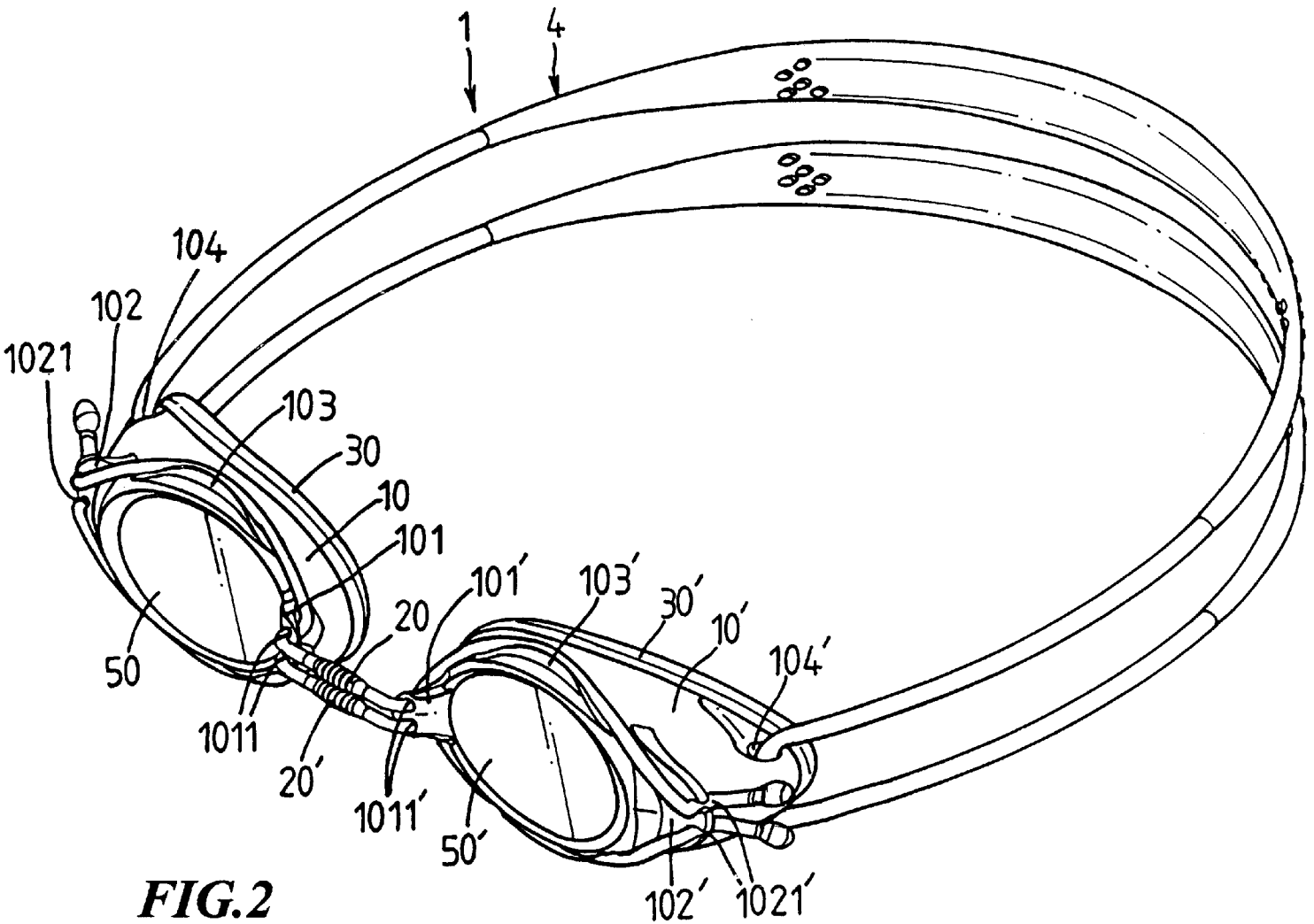
FIG. 2 is a perspective view of the invention of swimming goggles with step-less adjustment.
Figure 5:
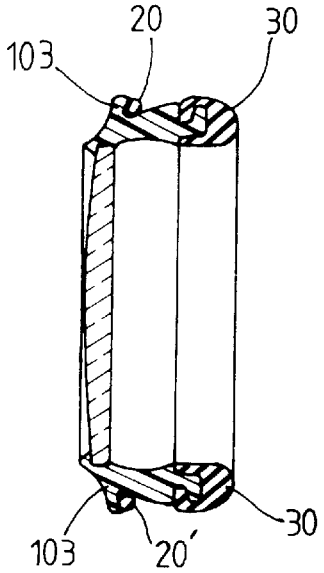
FIG. 5 is a longitudinal section view of the lens frame unit in the subject invention of swimming goggles with step-less adjustment.

As shown in FIG. 2, the subject invention of swimming goggles 1 comprises the following: two lens frame units 10 and 10', two strings 20 and 20', two protective pads 30 and 30', and a headband device 4. Said two lens frame units 10 and 10' are positioned left and right and respectively accommodating two lenses 50 and 50'. Said two lens 50 and 50' are implanted and fixed onto the lens frame units 10 and 110'. On the inside ends of the two lens frame units 10 and 10' are fixed two first joining units 101 and 101', while on the outside ends of the two lens frame units 10 and 10' are fixed two second joining units 102 and 102'. On the first and second joining units 101, 101' and 102, 102' are respectively two accommodating holes involving clasp openings 1011, 1011' and 1021, 1021' serving to clasp one ends of the two strings 20 and 20'. Extending from and correspondingly on the upsides and downsides of the lens frame units 10, 10' are clasp pieces 103, 103'. Said clasp pieces 103, 103' and the lens frame units 10, 10' are combined to form a fixing groove, as shown in FIG. 5, which serves to fix the winding strings in position. On the lens frame 10, 10' and next to the second joining units 102, 102' are two through holes 104, 104' that serve to accommodate the insertion of the headband device 4.

Said two strings 20 and 20', made of a flexible material, are respectively pulled through said accommodating holes involving clasp openings 1011, 1011'. The strings are pulled around the clasp pieces 103 and 103' on the edges of the two lens frame units 10 and 10', with appropriate stretches extended from the outside ends of the lens frame units 10, 10', ending in the shape of a ball to enable convenient handling by the user's hand. Said protective pads 3 are respectively inserted in the far sides of the two lens frames 10 and 10' away from the lenses 50 and 50', each having a face contact part 30 or 30' with adequate flexibility to provide comfortable contact with the user's face and the effects of better attraction and resistance to seepage.

Pleaser refer to FIG. 2, the subject invention of swimming goggles is assembled in the following steps: the middle parts of the two strings 20 and 20' are snapped onto the accommodating holes of the clasp openings 1011, 1011' of the first joining units 101, 101 ' on the lens frame units 10, 10', then along the rims of the lens frame units 10, 10' and snapped onto the clasp pieces 103, 103'. Then, the ends of the two strings 20 and 20' are snapped in position onto the second joining units 102, 102'. maintaining an appropriate distance from the two lens frame units 10, 10', and exposing a small section at the end of the two strings 20 and 20', so the two lens frame units 10 and 10' can be joined as one unit.

Figure 3:
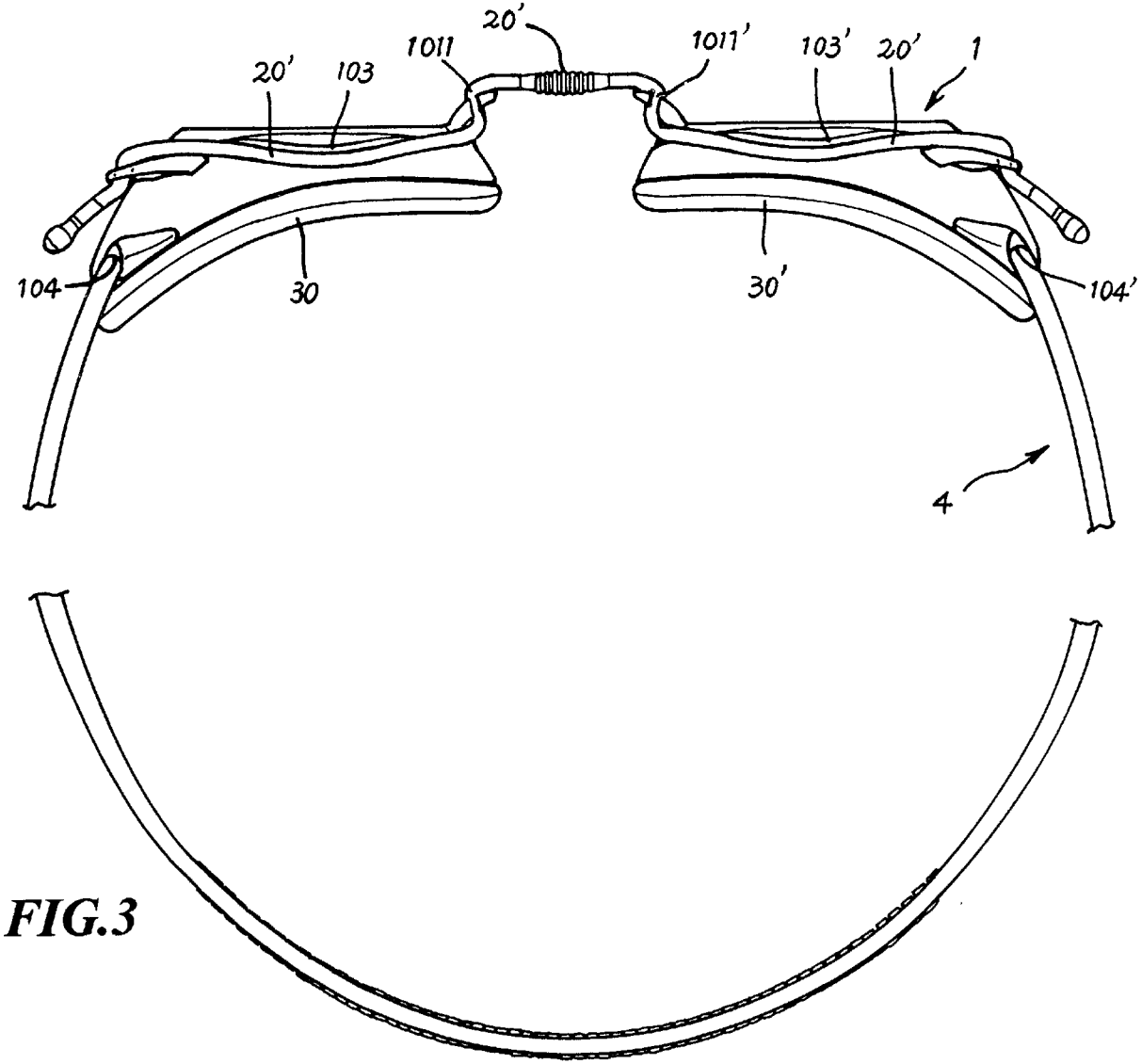
FIG. 3 is a top view of the invention of swimming goggles with step-less adjustment.
Figure 4:
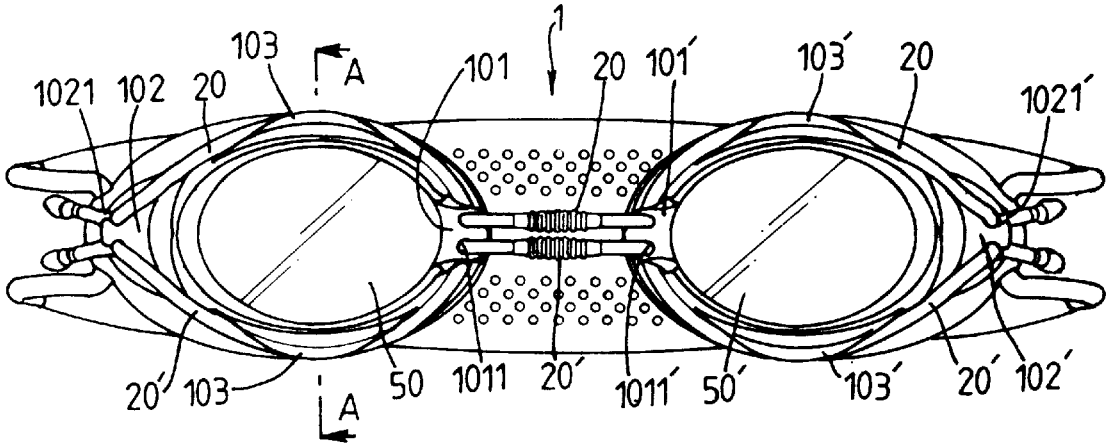
FIG. 4 is a front view of the invention of swimming goggles with step-less adjustment.

In the adjustment of the span of the invention of swimming goggles, as shown in FIGS. 3 and 4, just pull out the string 20 (20') from one side of the second joining unit 102 (102') to the clasp opening 101 1(1011') , and adjust the length of the upper and lower strings 20, 20' to suit the user's requirement of different arc formation and provide comfortable contact with the user's face. The span of the nose bridge of the invention of swimming goggles is adjusted by changing the length of the two strings 20 and 20', thus enabling step-less adjustment to suit the nose bridge configuration of different users who can feel comfortable.

One feature that must be mentioned is that, due to the innovated assembling and configuration of the subject invention of swimming goggles, an entire set or an individual frame unit can be sold to a buyer who may have multiple options to purchase a single-sided lens and frame of a different style or color.

Having proved that the subject invention is capable of achieving the anticipated objective, as described above, it has met the qualification for a patent right. However, the above description has covered merely the preferred embodiment of the subject invention. It is declared herewith that all equivalent modifications and/or variations deriving from the above shall be included in the spirit of the subject claims.

What is claimed is:

1. A type of swimming goggles with step-less adjustment, comprising:

two lens frame units, each said lens frame unit housing a lens, on a first end of each said lens frame units is a first joining unit, and on a second end of each said lens frame unit is a second joining unit, said first joining units being on an inner side of said lens frame units, and said second joining units being on an outer side of said lens frame units and corresponding in position to said first joining units, each of said joining units including an arced portion with two accommodating holes with clasp openings;

a first string and a second string, said first string being secured in a fixing groove formed by a clasp piece extending from an upper rim of said lens frame units, and a second string being secured in a fixing groove formed by a clasp piece extending from a lower rim of said lens frame units, said strings maintaining said lens frame units at a desired distance, said strings being secured in said accommodating holes of said first and second joining units on each said lens frame unit and extending past said lens frame units so that ends of said string are exposed; and a headband device, said headband device being joined to an outside edge of said lens frame units, said headband device comprising at least a headband; such that a user regulates positions of said strings on the two lens frame units to control a width of a nose bridge formed by said strings, thereby controlling a separation length of said lens frame units.

2. The swimming goggles as claimed in claim 1, wherein:

through holes are included on said lens frame units near said second joining units to receive said headband.

3. A type of swimming goggles with step-less adjustment, comprising:

two lens frame units, each said lens frame unit housing a lens, on a first end of each said lens frame units is a first joining unit, and on a second end of each said lens frame unit is a second joining unit, said first joining units being on an inner side of said lens frame units, and said second joining units being on an outer side of said lens frame units, at least one string, said string being secured to said first and second joining units of said two lens frame units so as to maintain a desired separation distance between said two lens frame units, said string extending past said lens frame units so that ends of said string are exposed, and a headband device comprising at least a headband, said headband device being joined to said second joining units on outside surfaces of said two lens frame units; wherein said first and second joining units comprise accommodating holes with clasp openings that secure two ends of said at least one string, and a user adjusts said separation distance to adjust a width of a nose bridge by moving said string.

4. The swimming goggles as claimed in claim 3, wherein:

clasp pieces extend along an upper rim and a lower rim of each said lens frame units to form fixing grooves to secure said at least one string.

5. The swimming goggles as claimed in claim 4, wherein:

through holes are included on said lens frame units near said second joining units to receive said headband.

6. A lens frame unit adapted to be a component of swimming goggles, comprising:

a first joining unit situated on a first end of end of said lens frame unit, a second joining unit situated on a second end of said lens frame unit, said first joining unit is located on an inner side of said lens frame unit, and said second joining unit is located on an outer side of said lens frame unit, each said joining unit comprising accommodating holes with two clasp openings, and two strings, said strings passing along upper and lower rims of said lens frame unit and through said accommodating holes in said first and second joining units of said lens frame unit, a first end of said strings past said lens frame units so that ends of said string are exposed; wherein clasp pieces extend along an upper rim and a lower rim of said lens frame unit to form a fixing groove to secure said strings.

7. The lens frame unit as claimed in claim 6, wherein:

through holes are included on said lens frame units near said second joining units, said through holes being adapted to receive a headband.

* * * * *